US007328486B2

(12) United States Patent
Farchione

(10) Patent No.: US 7,328,486 B2
(45) Date of Patent: Feb. 12, 2008

(54) UTILITY CLIP

(76) Inventor: Samuel Farchione, 300 Myrtle Dr., Nakomia, FL (US) 34275

( * ) Notice: Subject to any disclaimer, the term of this patent is extended or adjusted under 35 U.S.C. 154(b) by 42 days.

(21) Appl. No.: 11/385,176

(22) Filed: Mar. 21, 2006

(65) Prior Publication Data

US 2006/0236506 A1 Oct. 26, 2006

Related U.S. Application Data

(60) Provisional application No. 60/674,862, filed on Apr. 26, 2005.

(51) Int. Cl.
*A44B 21/00* (2006.01)

(52) U.S. Cl. ..... 24/3.12

(58) Field of Classification Search ..... 24/3.1, 24/3.12, 3.11, 132 R; 248/51; 224/269
See application file for complete search history.

(56) References Cited

U.S. PATENT DOCUMENTS

| | | | | |
|---|---|---|---|---|
| 334,101 | A | 1/1886 | Buffum | |
| 463,786 | A | 11/1891 | Davidson | |
| 1,127,832 | A | 2/1915 | Voigt | |
| 1,206,074 | A | 11/1916 | Bryner | |
| 1,396,499 | A | 11/1921 | Bell | |
| 1,775,011 | A | 9/1930 | Wichmann | |
| 2,320,067 | A | 5/1943 | Caughren | |
| 2,388,811 | A | 11/1945 | Zatko | |
| 2,551,019 | A | 5/1951 | Pierre | |
| 3,052,002 | A | 9/1962 | Lesher | |
| 3,104,434 | A | 9/1963 | Noordhoek | |
| 3,155,298 | A * | 11/1964 | Brown | 224/268 |
| D204,446 | S | 4/1966 | Bardon | |
| 3,279,009 | A | 10/1966 | Deane | |
| 3,718,241 | A * | 2/1973 | Forsythe | 224/250 |
| 3,808,642 | A | 5/1974 | Nation | |
| 3,809,349 | A * | 5/1974 | Baedke | 248/51 |
| 4,974,764 | A | 12/1990 | Cantwell | |
| 5,050,786 | A | 9/1991 | DeMott | |
| 5,979,851 | A | 11/1999 | Purdy | |
| 6,286,736 | B1 | 9/2001 | Angus et al. | |
| 6,336,578 | B1 | 1/2002 | Maynard | |
| 6,526,635 | B2 * | 3/2003 | Nasu et al. | 24/543 |
| 2003/0201287 | A1 | 10/2003 | Fisher | |
| 2005/0035164 | A1 | 2/2005 | Badillo | |

OTHER PUBLICATIONS

Product Description—Plantronics Cord Clip—Model #10778-00.

* cited by examiner

*Primary Examiner*—James R Brittain
(74) *Attorney, Agent, or Firm*—Gifford, Krass, Sprinkle, Anderson & Citowski, P.C.

(57) ABSTRACT

A utility clip may include a base and a cover that is pivotably secured to the base. The base may include a pair of guide flanges that, along with the cover, cooperate to create a passage to retain and support a cable or wire. The guide flanges may be angled in the manner that creates a generally smooth path of travel for a cable or wire retained in the clip. As a result, the flanges may prevent kinking or over-bending of the wire or cable. Furthermore, by creating a path of travel for the wire or cable the user may avoid tangling the wire or cable around himself/herself or around other nearby wires, cables or equipment.

16 Claims, 3 Drawing Sheets

UTILITY CLIP

CROSS-REFERENCE TO RELATED APPLICATIONS

This application claims priority from pending U.S. Provisional Application No. 60/674,862, filed on Apr. 26, 2005 for a Utility Clip.

BACKGROUND OF THE INVENTION

1. Field of the Invention

The present invention is directed to a utility clip. More specifically, the invention is directed to a utility clip that may be removably secured to a belt, pocket or the like and that may operate to support a cable, wire or an array of objects having handles of appropriate dimension.

2. Reference to Related Art

Countless number of activities require the use of corded power tools and instruments. For example, a barber or hairstylist may use corded electric shears to trim a person's hair. Likewise, a construction worker or landscaper may use a corded saw or hedge trimmer, respectively, to assist them in their work.

Prior art cable-supporting clips include that of U.S. Pat. No. 3,155,398, which included an elongated shank and a generally U-shaped hanger portion. The shank portion of the clip may be inserted into a user's pocket. Once inserted, the side portion of the U-shaped hanger cooperated with the shank to frictionally hold the clip in position. Once in position, a cable may be inserted into the U-shaped hanger of the clip so that the cable was out of the way during use.

U.S. Pat. No. 3,809,349 was directed to a cord holder that included a clip portion that could be slip fit over a user's belt. A crosspiece extended outwardly from one side of the clip portion and another wall extended upwardly from the crosspiece. As such, the clip and crosspiece and wall worked together to form a generally U-shaped channel. Further, a roller member was positioned in the channel to assist in the movement of an electrical cord through the channel.

The Belt Buddy, described in U.S. Pat. No. 5,979,851, included a hook or clip-like upper end and a lower end that included an adjustable loop. A variety of arrangements are disclosed for clipping the Belt Buddy to a user and for forming the adjustable loop.

Another reference of interest is U.S. Pat. No. 6,336,578, which disclosed a cord holder that could be affixed to a user's clothing and was capable of creating slack in an electrical cord for a handheld workpiece.

Finally, U.S. patent application Ser. No. 2003/0201287 disclosed an electrical cord holder that was securable to a user's belt. The holder included a base portion, a front portion that extended off of the base portion and a clip portion. As such, the holder was designed so that it may be secured to a user's belt in the space between the base and front portion. Once secured, the clip could be used to retain an electrical cord or cable.

SUMMARY OF THE INVENTION

A utility clip that may be removably positioned on a user's belt may include a base and a cover that is hingedly secured to the base. The base itself may include a pair of guide flanges that, along with the cover, cooperate to create an enclosed passage that may retain and support a cable or wire. The guide flanges are angled such that the "high" end may be positioned proximate a longitudinal axis of the base and the "low" end may be proximate an outside edge of the base. Angling the guide flanges in this manner creates a generally smooth path of travel for a hanging cable or wire that is retained in the clip. As a result, the flanges may prevent kinking or over-bending of the wire or cable. Furthermore, by creating a path of travel for the wire or cable, the user may avoid tangling the wire or cable around himself/herself or around other nearby wires, cables or equipment.

A spring element may be provided to bias the cover into a closed position. The shape of the body cover may also be customized according to the needs of the user and it may feature graphics, text or other manner of indicia.

BRIEF DESCRIPTION OF THE DRAWINGS

Reference will now be had to the attached drawings wherein like reference numerals refer to like parts throughout and wherein.

DETAILED DESCRIPTION OF THE INVENTION

Figure 1:
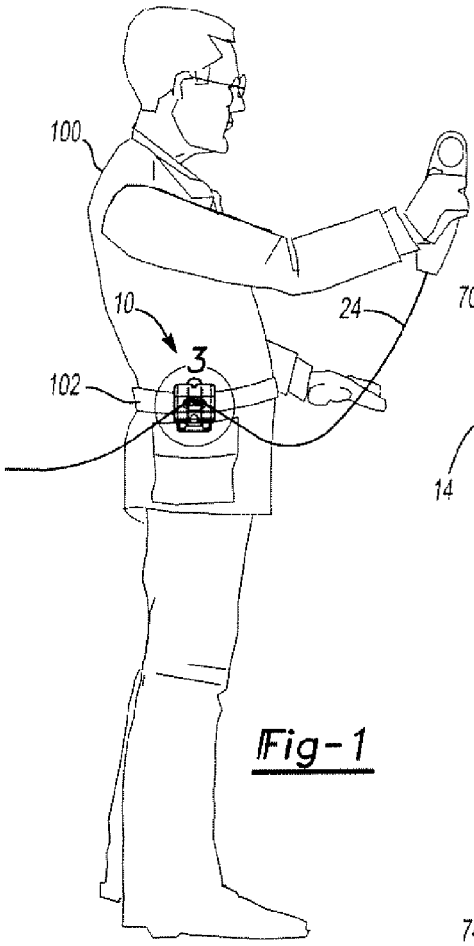
FIG. 1 is an environmental perspective view of a figure holding an embodiment of a utility clip.
Figure 2:
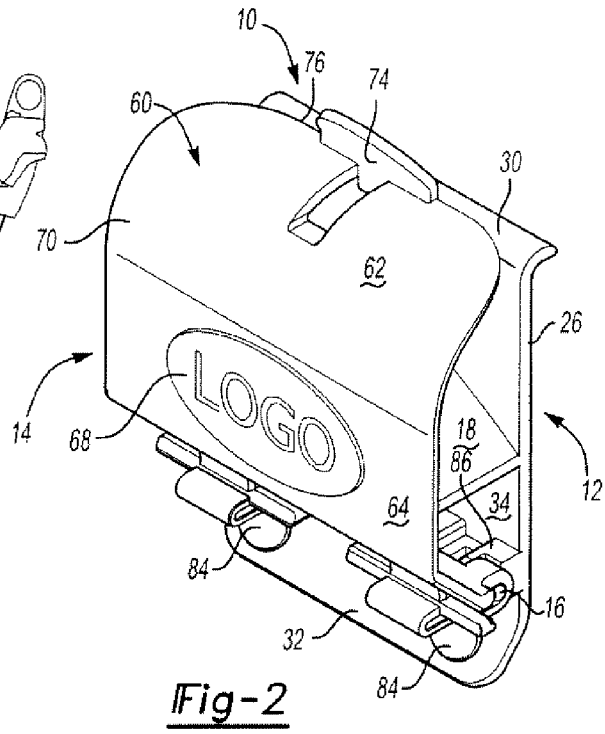
FIG. 2 is a front-right side perspective view of an embodiment of a utility clip.
Figure 3:
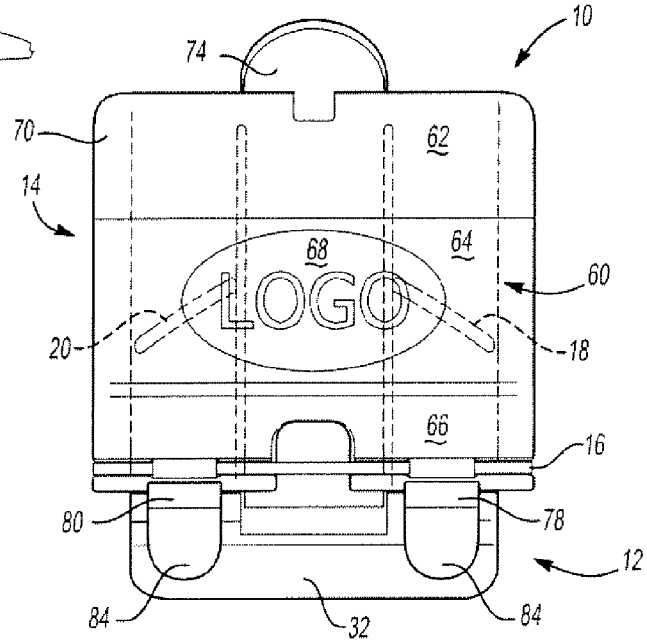
FIG. 3 is a front view of the utility clip of FIG. 2.

Referring now to FIGS. 1-7 and as best shown in FIGS. 2-7, a utility clip 10 may be constructed to include a base 12 and a cover 14 that is secured using a hinge pin 16 to the base 12. The base 12 may include a pair of guide flanges 18, 20 that, along with the cover 14, cooperate to create an enclosed passage 22 to retain and support a cable or wire 24. The base 12 may be removably positioned on a user's 100 belt 102, pocket or the like. Furthermore, the utility clip 10 or any of its constituent parts may be constructed of a polymer, such as plastic, a metal or metal alloy or a combination thereof using molding or other techniques known in the art.

Figure 4:
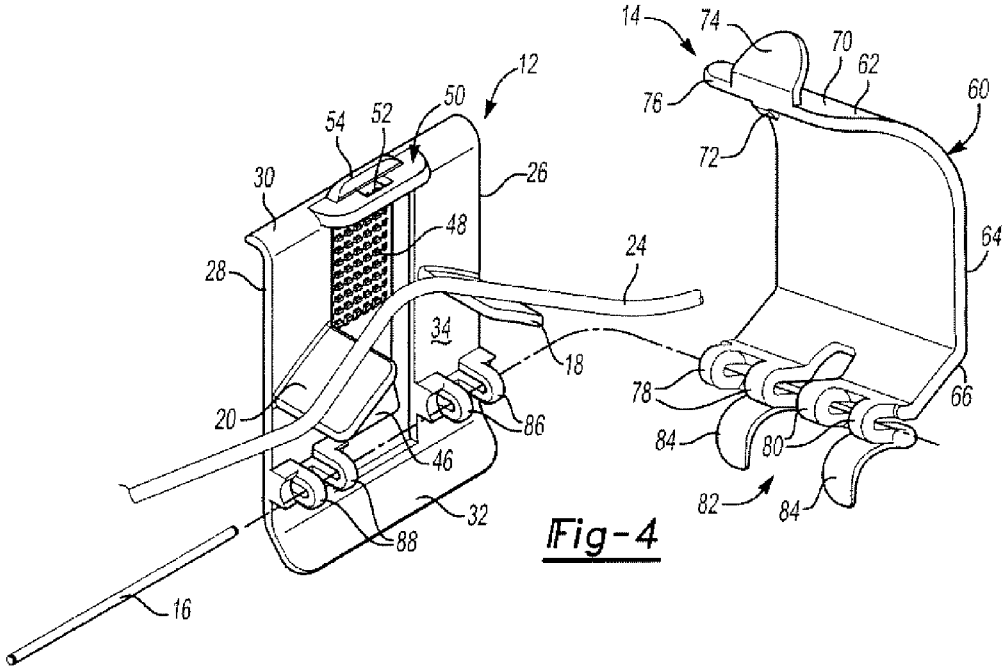
FIG. 4 is an exploded perspective view of an embodiment of a utility clip showing a front of a base portion and a rear of a cover portion.
Figure 5:
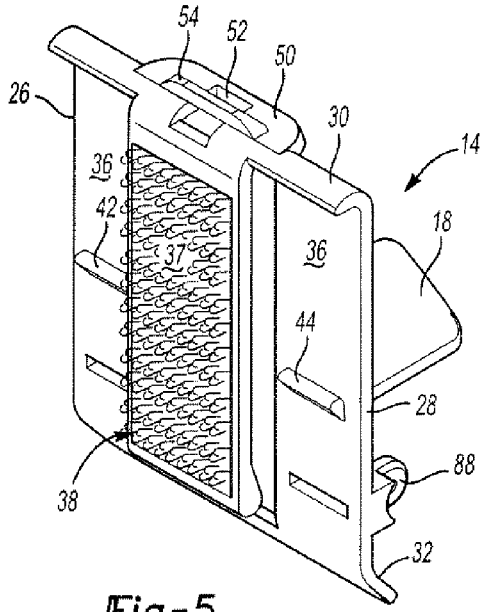
FIG. 5 rear-left side perspective view of a base portion of an embodiment of a utility clip.

Referring now to FIGS. 4 and 5, the base 12 of the utility clip 10 may include a first 26 and second 28 parallel side members that are secured together at each end by a top 30 and bottom 32 cross member. The side and cross members 26, 28, 30, 32 all include an interior 34 surface and an exterior 36 surface. Further, a mounting arm 38 may be provided for securing the clip 10 to a user 100 as will be described below. The bottom cross member 26 may also be angled with respect to a plane of the base 14 such that it may be engaged by the cover 14, again as will be described below.

Figure 6:
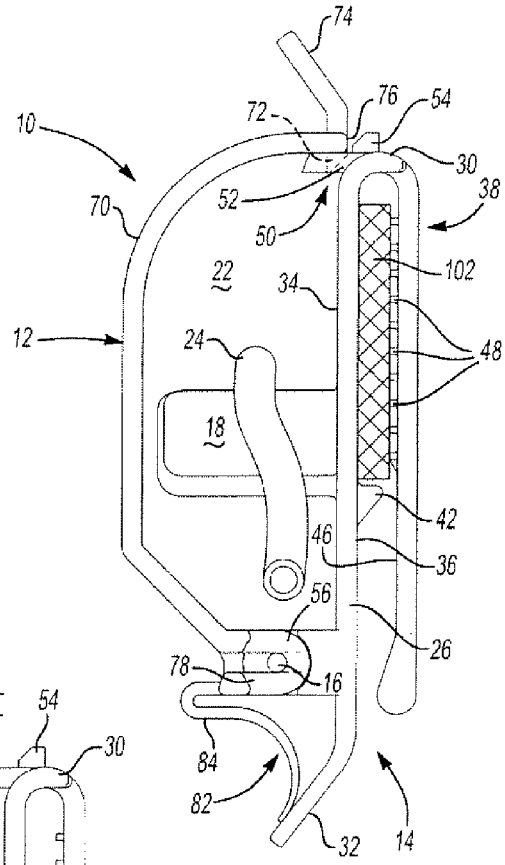
FIG. 6 is a planer right side view of an embodiment of a utility clip with the cover closed.
Figure 7:
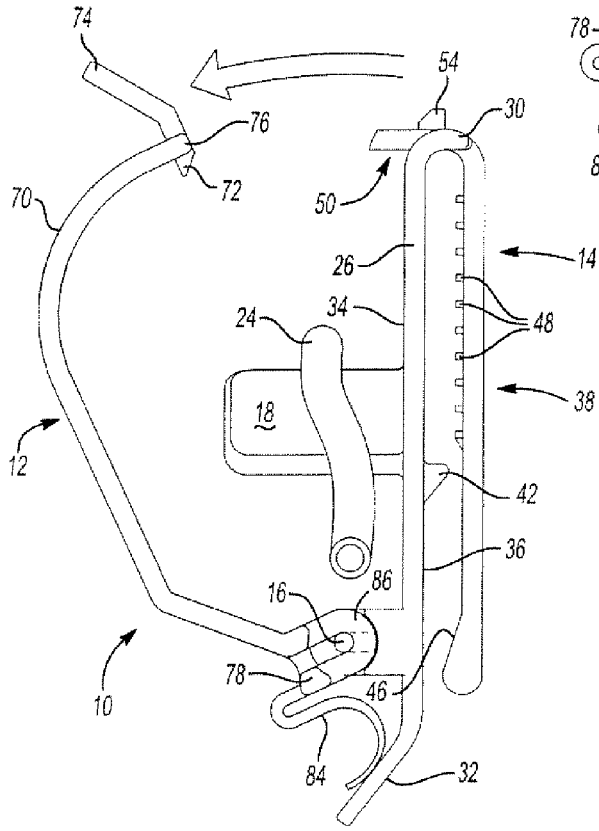
FIG. 7 is a planer right side view of an embodiment of a utility clip with the cover open.

Referring now to FIGS. 5-7, the arm 38 extends from the top cross member 30 such that it may be spaced apart from, but between and parallel to, the first 26 and second 28 side members (i.e., the arm 38 is centered). As best shown in FIGS. 6 and 7, spacing the arm 38 from the exterior surface 36 of the base 12 creates a channel 40 that may accommodate the user's belt 102 or the like. In this regard, a pair of retaining tabs 42, 44 may be positioned on the exterior surface 36 of the side members 26, 28 and may function to maintain a belt 102, or the like, in the channel 40 during use of the clip 10. Furthermore, as shown in FIG. 4, an interior surface 46 of the arm 38 may include raised friction elements 48 that assist in holding the arm 38, and thus the base 12, in position when secured to a user's belt 102. As an alternative, or in addition to the arm 38, a fastener may be affixed to the exterior surface 36 of the base 12 for mounting the clip 10 to objects and things (i.e., walls, furniture, etc.) For example, if the clip 10 does not include an arm 38, the fastener may include an adhesive strip or a hook and loop fastener 37 (e.g., VELCRO) that is positioned on the exterior surface 36. Alternatively, if the clip 10 does include an arm 38, the fastener may include an adhesive strip or a hook and loop fastener 37 (e.g., VELCRO) that is positioned on an exterior surface 38 of the base 12 or an exterior surface of the arm 38.

A flange 50 that may extend forward of the interior surface 34 of the base 12 may be positioned on top cross member 30. The flange 50 may include an aperture 52 and a stop 54 for use in securing the cover 14, as will be described below.

As best shown in FIGS. 4-7, the guide flanges 18, 20 may be positioned on and extend from the exterior surface 36 of each side member 26, 28. As best shown in FIG. 4, each guide flange 18, 20 is angled diagonally downward relative to the top cross member portion 30, such that the flanges 26, 28 may be mirror images of one another. Stated differently, the guide flanges 18, 20 are diagonally angled such that the "high" end is positioned proximate a longitudinal axis of the base 14 and the "low" end is proximate an outside edge of the base 14. Angling the guide flanges 18, 20 in this manner creates a path of travel for a cable or wire 24 retained in the clip 10. For example, as shown a wire or cable 24 may be positioned such that it travels over both flanges 18, 20. As a result, the use of the flanges 18, 20 may prevent kinking or over-bending of the wire or cable 24. Furthermore, by creating this path of travel for the wire or cable 24, the user may avoid tangling the wire or cable 24 around himself/herself or around other nearby wires, cables or equipment. Alternatively, a wire or cable 24 may be positioned such that it travels over one flange and under the other. This latter arrangement may provide the desired effect of restricting the smooth travel of the wire or cable 24. It is also understood that the present invention is not limited to supporting a wire or cable 24, but that the flanges 18, 20 may be used to support other objects, such as the handle of a paint can (not shown) and other objects with handles of appropriate dimension.

Still referring to FIGS. 4-7, a pair of hinge brackets 56, 58 may likewise be positioned on and extend from the exterior surface 36 of each side member 26, 28. As will be discussed, the hinge bracket 56, 58 may cooperate with like elements on the cover 14 and the hinge 16 to secure the cover 14 to the base 12.

Referring now to FIGS. 1-7, the cover 14 may include a shaped body 60. The body 60 shown in the figures has three principal surfaces 62, 64, 66. However, it will be appreciated that the shape of the body 60 is not limited to that shown in the figures. It will also be appreciated that graphic indicia 68, such as text, a design, advertising indicia, or the like may be printed or carved on an exterior surface 70 of the cover 14 according to the needs of the user.

Referring now to FIGS. 2-7, the cover 14 may include a catch 72 and tab 74 that may be positioned at an end 76 of the body 60. As best shown in FIG. 6, when the cover 14 is closed, the catch 72 may releasably engage the aperture 52 of the flange 50 while the stop 54 guards against over travel of the cover 14. The cover 14 may also include a pair of hinge brackets 78, 80 that, as mentioned above, may be positioned proximate (or otherwise cooperate with) the hinge bracket 56, 58 of the base 14 and then secured in position by the pin 16.

Referring now to FIGS. 2-4 and 6-7, the cover 14 may be biased into a closed position with respect to the base 12 by a spring 82. As best shown in FIGS. 6 and 7, in the illustrated embodiment, the springs 82 may include resilient, curved portions 84 of the cover 14 that extend from the cover 14 proximate the hinge brackets 78, 80 and operate to engage the angled bottom cross member 32 of the base 14. In this regard, it will be appreciated that the spring may be formed integrally with the cover 14. However, other springs such as the spring hinge assembly disclosed in applicant's provisional application No. 60/674,862, the disclosure of which is incorporated by reference in its entirety into this application, may also be used.

Having thus described my invention, various other embodiments will become apparent to those having skill in the art that do not depart from the scope of appended claims.

I claim:

1. A utility clip for comprising:

a base including a top and a bottom, an interior and exterior surface, an arm and a pair of guide flanges, the arm extends from the top of the base and is spaced from the exterior surface, the guide flanges extend from the interior surface of the base and operate to support a wire or cable; and a cover secured to the base, the cover being movable between a closed and an open position.

2. The utility clip of claim 1 wherein each guide flange of the pair of guide flanges is angled relative to the top of the base.

3. The utility clip of claim 1, wherein the cover further comprises a spring for biasing the cover in the closed position.

4. The utility clip of claim 3, wherein the spring further comprises a resilient, curved body portion that is operable to engage the base of the clip.

5. The utility clip of claim 1, wherein the cover further comprises graphic indicia.

6. The utility clip of claim 1, wherein the arm further comprises a friction element.

7. The utility clip of claim 1, wherein the base further comprises a retaining tab.

8. A utility clip for retaining:

a base having a top and a bottom, an interior and exterior surface, an arm, and a pair of guide flanges, a fastener positioned on the exterior surface for mounting the base to an object, the guide flanges are angled relative to the top of the base and are operable to support a wire or cable; and a cover movably secured to the base, the cover including a resilient body portion operable to engage the base of the clip to bias the cover into a closed position.

9. The utility clip of claim 8, wherein the cover further comprises graphic indicia.

10. The utility clip of claim 8, wherein the fastener further comprises a hook and loop fastener.

11. The utility clip of claim 8, wherein the base further comprises a retaining tab.

12. A utility clip for retaining wire and cable comprising:

a base including a first and second side member having an interior and exterior surface, a top cross member extending between a top edge of the side members, a bottom cross member extending between a bottom edge of the side members and an arm that extends from the top cross member and is spaced from the exterior surface the side members, the bottom cross member being angled inwardly, and each side member including a guide flange that extends from the interior surface of the side member; and a cover pivotably secured to the base, the cover including a spring operable to bias the cover into a closed position.

13. The utility clip of claim 12, wherein the cover further comprises graphic indicia.

14. The utility clip of claim 12, wherein each side member further comprises a retaining tab positioned on the exterior surface.

15. The utility clip of claim 12, wherein the arm further comprises a friction element.

16. The utility clip of claim 12, wherein the spring further comprises a resilient, curved body portion that is operable to engage the base of the clip.

* * * * *